US010731918B1

(12) United States Patent
Patel et al.

(10) Patent No.: US 10,731,918 B1
(45) Date of Patent: Aug. 4, 2020

(54) SINGLE-LAYER APPLIANCE INDICATOR LIGHT WITH SIDE-FIRE LED

(71) Applicant: Haier US Appliance Solutions, Inc., Wilmington, DE (US)

(72) Inventors: Sanchit Jitendra Patel, Louisville, KY (US); Brian J. Morman, Louisville, KY (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/683,853

(22) Filed: Nov. 14, 2019

(51) Int. Cl.

| | |
|---|---|
| ***F25D 29/00*** | (2006.01) |
| ***F25D 27/00*** | (2006.01) |
| ***H05B 39/04*** | (2006.01) |
| ***F21V 23/00*** | (2015.01) |

(52) U.S. Cl.
CPC ..... *F25D 27/005* (2013.01); *F21V 23/003* (2013.01); *H05B 39/042* (2013.01)

(58) Field of Classification Search
CPC ..... F25D 29/00; F25D 27/005; F25D 23/126; F25D 2400/361; G02B 6/009; G02B 6/0095; G02B 6/0088; G02B 6/0083; G02B 6/0073; F21V 33/0044; F21V 23/003; H05K 3/30; H05K 5/0017; H05K 1/18; H05K 1/181; H03K 17/962; H03K 2217/96075; H03K 2217/96079; H03K 2217/960795; H03K 2217/9655; D06F 34/28; D06F 33/00; H05B 39/085; H05B 45/00
See application file for complete search history.

(56) References Cited

U.S. PATENT DOCUMENTS

| | | | | |
|---|---|---|---|---|
| 7,705,257 | B2 * | 4/2010 | Arione | H03K 17/962 200/314 |
| 8,477,506 | B2 * | 7/2013 | Moncrieff | H05K 5/0243 361/748 |
| 9,179,554 | B2 | 11/2015 | Schuh | |
| 9,940,857 | B2 | 4/2018 | Heater et al. | |
| 9,971,322 | B2 * | 5/2018 | Bach | G06F 3/04847 |
| 10,147,571 | B2 | 12/2018 | Ebrom et al. | |
| 10,416,372 | B2 * | 9/2019 | Doering | G02B 6/0095 |
| 2011/0181516 | A1 | 7/2011 | Mallory et al. | |
| 2015/0208897 | A1 | 7/2015 | Kangas et al. | |
| 2016/0071443 | A1 | 3/2016 | Heater et al. | |
| 2016/0124539 | A1 | 5/2016 | Giacomini et al. | |
| 2020/0018004 | A1 * | 1/2020 | Leisl, III | D06F 34/28 |

* cited by examiner

*Primary Examiner* — Haissa Philogene
(74) *Attorney, Agent, or Firm* — Dority & Manning, P.A.

(57) ABSTRACT

An appliance includes a control console. The control console includes a console cover with a circuit board. A front surface of the circuit board is attached to an interior surface of the console cover. A capacitive touch sensor is in operative communication with a face surface of the console cover and an LED is on a back surface of the circuit board. A light guide is mounted on the circuit board and provides optical communication from the LED to the face surface of the console cover.

20 Claims, 9 Drawing Sheets

SINGLE-LAYER APPLIANCE INDICATOR LIGHT WITH SIDE-FIRE LED

FIELD

The present subject matter relates generally to indicator lights, such as may be used in control panels for appliances.

BACKGROUND

Appliances generally include a control panel having a plurality of buttons, keys, or other input devices. Utilizing the control panel, an appliance user can input control commands to the appliance and operate the appliance. Certain control panels include a plurality of indicator lights to provide visual information about the status of the appliance, such as selected cycles or options input by the user. Certain control panels include capacitive touch sensors that utilize a user's body capacitance to operate. In particular, capacitive touch sensors can detect a change in capacitance when the user touches the control panel.

Thus, some appliance control panels include capacitive touch sensors with corresponding indicator lights, e.g., where the corresponding indicator light is illuminated when the capacitive touch sensor is selected or activated. However, while it is desirable to minimize the size of the capacitive touch sensor, doing so can create difficulty in accommodating the corresponding indicator light within the same assembly while also providing the illumination in a desired location, such as a point or backlighting text associated with the corresponding capacitive touch sensor.

Accordingly, user interface assemblies that include one or more capacitive touch sensors in a compact assembly with corresponding indicator light or lights would be useful.

BRIEF DESCRIPTION

Aspects and advantages of the technology will be set forth in part in the following description, or may be apparent from the description, or may be learned through practice of the technology.

In an exemplary embodiment, an appliance is provided. The appliance includes a cabinet and a door rotatably mounted to the cabinet for movement between a closed position and an open position. The appliance also includes a control console positioned on the door. The control console includes a console cover extending from a face surface on an exterior surface of the door to an interior surface and a circuit board comprising a front surface attached to the interior surface of the console cover. A capacitive touch sensor is in operative communication with the face surface of the console cover. An LED is mounted on a back surface of the circuit board opposite the front surface of the circuit board. A light guide is mounted on the circuit board. The light guide provides optical communication from the LED to the face surface of the console cover.

In another exemplary embodiment, a control console for an appliance is provided. The control console includes a console cover extending from a face surface to an interior surface and a circuit board comprising a front surface attached to the interior surface of the console cover. A capacitive touch sensor is in operative communication with the face surface of the console cover. An LED is mounted on a back surface of the circuit board opposite the front surface of the circuit board. A light guide is mounted on the circuit board. The light guide provides optical communication from the LED to the face surface of the console cover.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures.

DETAILED DESCRIPTION

Figure 1:
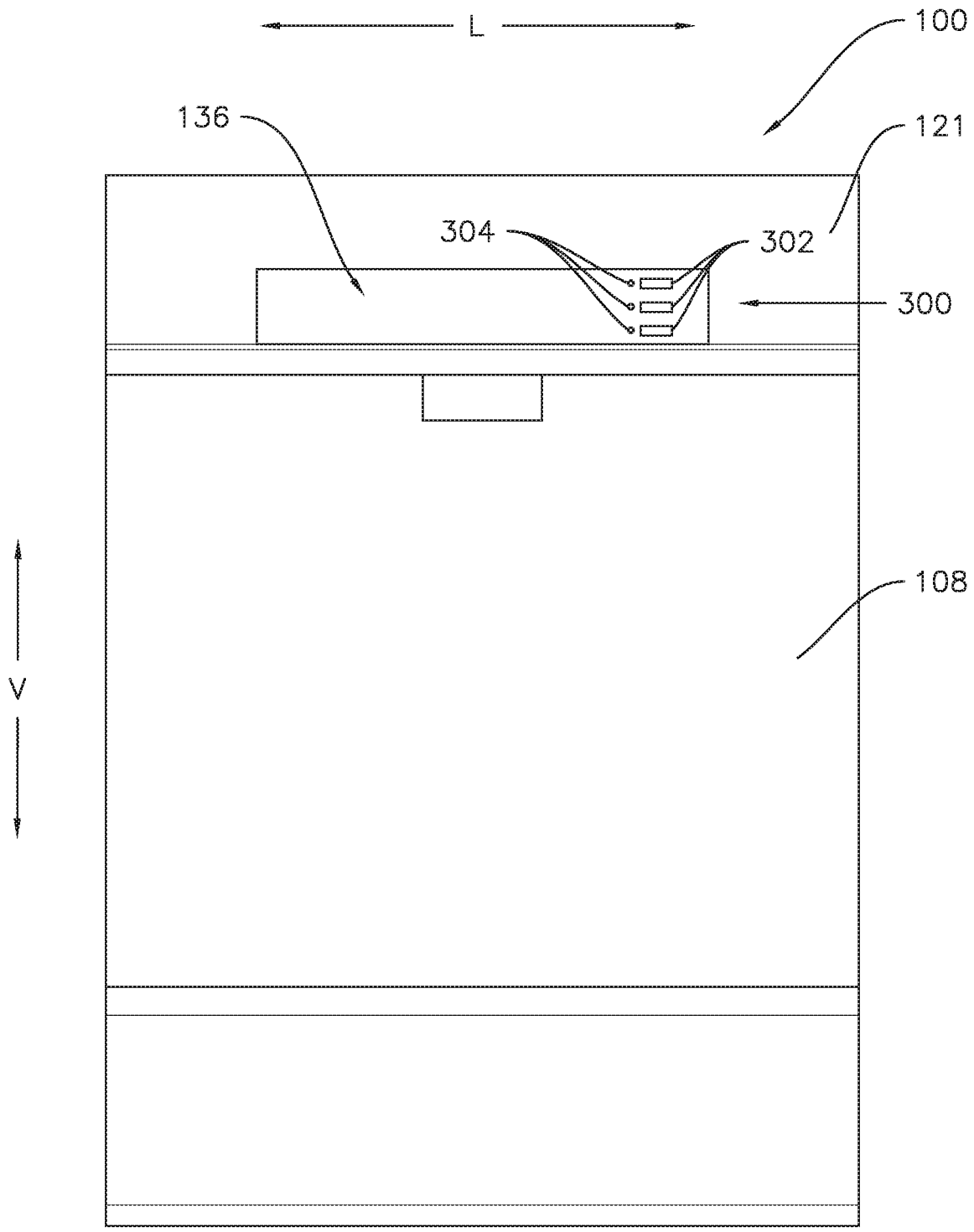
FIG. 1 provides a front view of an example dishwashing appliance as may incorporate a control console in accordance with at least one embodiment of the present subject matter.

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present disclosure without departing from the scope or spirit of the invention. For instance, features illustrated or described as part of one embodiment can be used with another embodiment to yield a still further embodiment. Thus, it is intended that the present technology covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
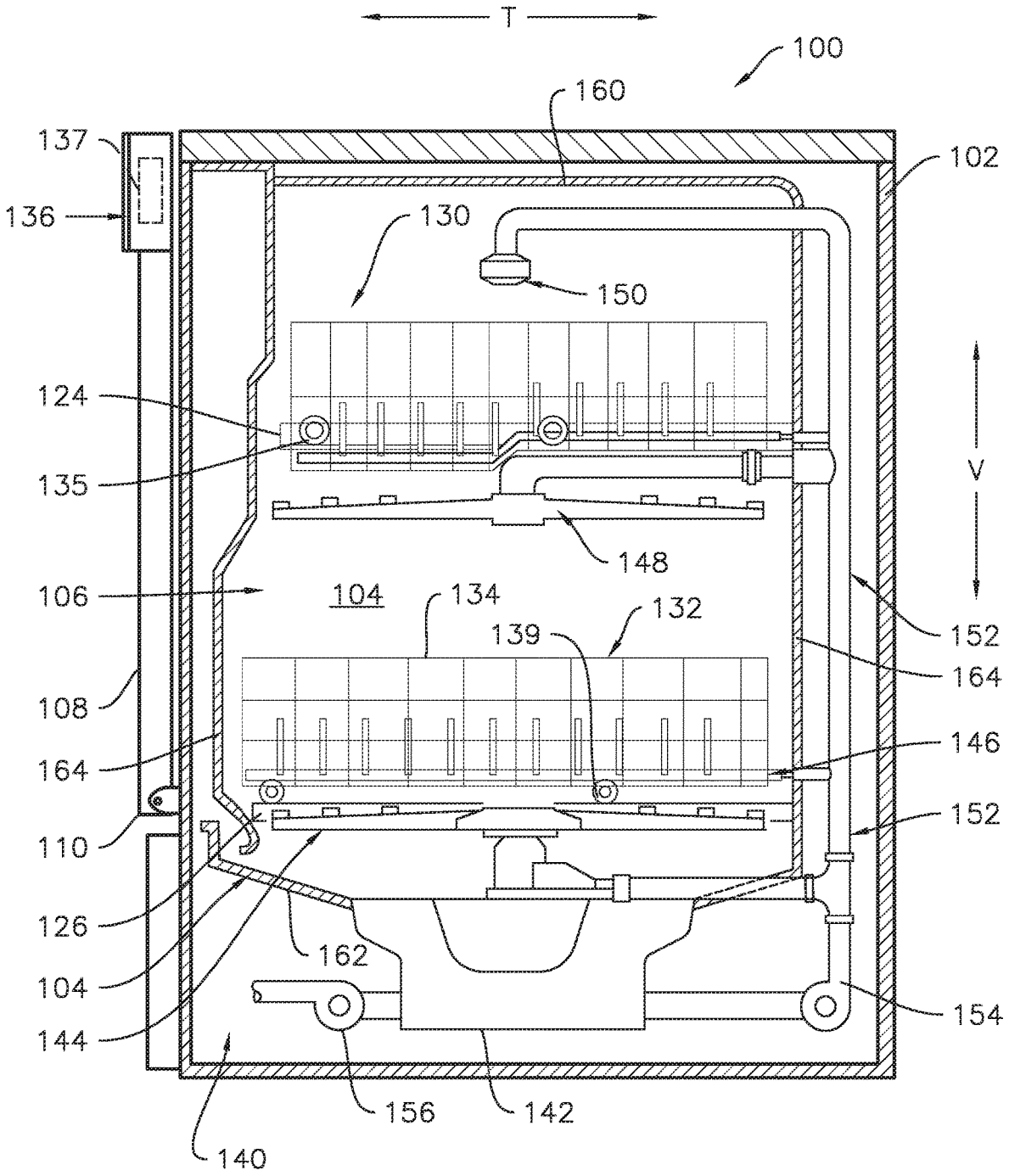
FIG. 2 provides a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may incorporate a user interface assembly or control console in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position (not shown) for loading and unloading of articles from the dishwashing appliance 100.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132. As may be seen collectively in FIGS. 1 and 2, the dishwashing appliance 100 may define the vertical direction V, the transverse direction T, and a lateral direction L. The vertical direction V, lateral direction L, and transverse direction T are mutually perpendicular and form an orthogonal direction system.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwashing fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 is in operative communication with a user interface panel/control console cover 136 through which a user may select various operational features and modes and monitor progress of the dishwasher 100. The console cover 136 may be a part of a control console 300, e.g., the console cover 136 may be a front panel of the control console 300. In one embodiment, the console cover 136 and/or control console 300 may represent a general purpose I/O ("GPIO") device or functional block. Additionally, the control console 300 may include input components, such as one or more of a variety of electrical, mechanical or electro-mechanical input devices including rotary dials, push buttons, touch pads, and touch screens. The console cover 136 may also include a display component, such as a digital or analog display device designed to provide operational feedback to a user. For example, the console cover 136 may include input components such as buttons 302, examples of which are illustrated in FIG. 1 and the display component may include a plurality of indicators 304, with each indicator 304 corresponding to a respective one of the buttons 302. The buttons 302 may be mechanical push buttons, capacitive touch sensors, or any other suitable type of button, including combinations of different types of buttons. As is generally understood, the control console 300 may be in communication with the controller 137 via one or more signal lines or shared communication busses. It should be noted that controllers 137 as disclosed herein are capable of and may be operable to perform any methods and associated method steps as disclosed herein. A variety of text, digits, and/or symbols may be printed on console cover 136 to indicate, e.g., which features or options of the appliance 100 are associated with each button 302.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the console cover 136, different configurations may be provided for the racks 130, 132, and other differences may be applied as well. Additionally, it should be appreciated that the control console 300 described herein may be useful in a variety of household appliances, such as but not limited to a cooktop or oven appliance, a laundry appliance, and/or a refrigerator appliance, among others.

Figure 3:
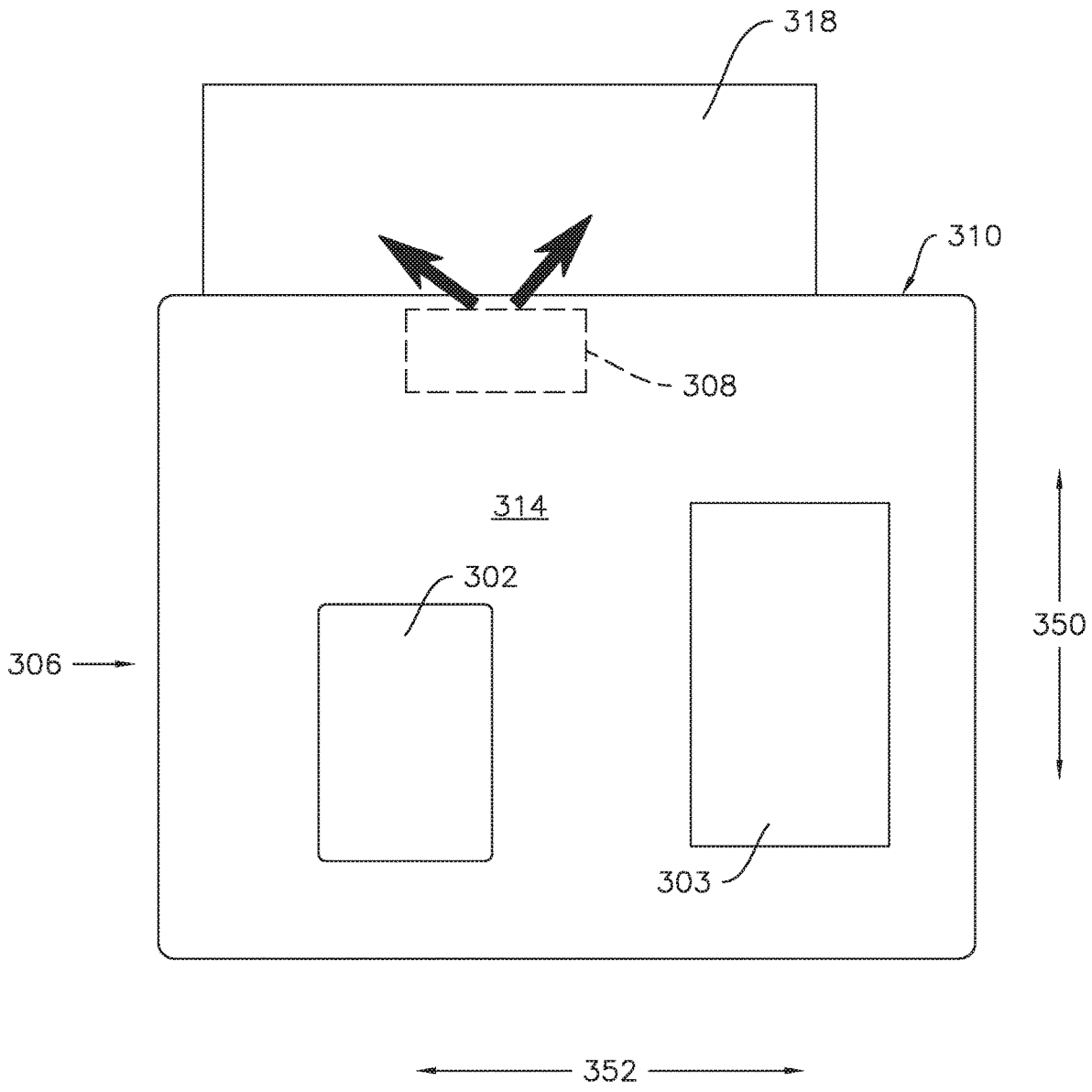
FIG. 3 provides a front view of a circuit board as may be incorporated into a control console for an appliance according to at least one exemplary embodiment of the present subject matter.

FIG. 3 illustrates an exemplary input assembly for an indicator 304 of an appliance. As shown in FIG. 3, the assembly includes a printed circuit board 306 with a button 302, e.g., a capacitive touch sensor, mounted on or in the printed circuit board 306. In various embodiments, the printed circuit board 306 may comprise multiple layers, and the capacitive touch sensor 302 may be located on any layer of the multilayer board. The printed circuit board 306 may comprise two major surfaces, a front surface 314 and an opposing back surface 312 (e.g., FIG. 6) which are spaced apart and joined by one or more edge surfaces 310. In various embodiments, the "front" surface 314 may also be considered a top surface or an outer surface of the printed circuit board 306. The printed circuit board 306 may also include a connector 303, e.g., for connecting a cable or wire by which the printed circuit board 306 may be in communication with the controller 137. In some embodiments, the printed circuit board 306 may also include a microcontroller thereon, e.g., for measuring or monitoring capacitance of the capacitive touch sensor in embodiments where the button 302 is a capacitive touch sensor. Additionally, the printed circuit board 306 may include one or more light-emitting diodes (LEDs) 308 mounted thereon. In particular, the one or more LEDs may be mounted on the back surface 312 of the printed circuit board 306, e.g., so as not to obstruct or interfere with the capacitive touch sensor 302 measuring or detecting capacitance at and around the front surface 314, and the one or more LEDs may be side-fire LEDs configured to emit light along a direction parallel to the major surfaces 312 and 314 of the printed circuit board 306. As will be described in more detail below, a light guide 318 may also be mounted on the circuit board 306. The light guide 318 may be optically aligned with the LED 308 and may provide optical communication from the LED 308 to a face surface 320 (e.g., FIG. 6) of the console cover 136. The capacitive touch sensor 302 is in operative communication with the face surface 320, e.g., the capacitive touch sensor 302 is positioned and configured to measure a capacitance at and around the face surface 320 in order to detect a touch, e.g., the presence of a user's finger, on the control console 300, as will be understood by those of ordinary skill in the art.

Figure 4:
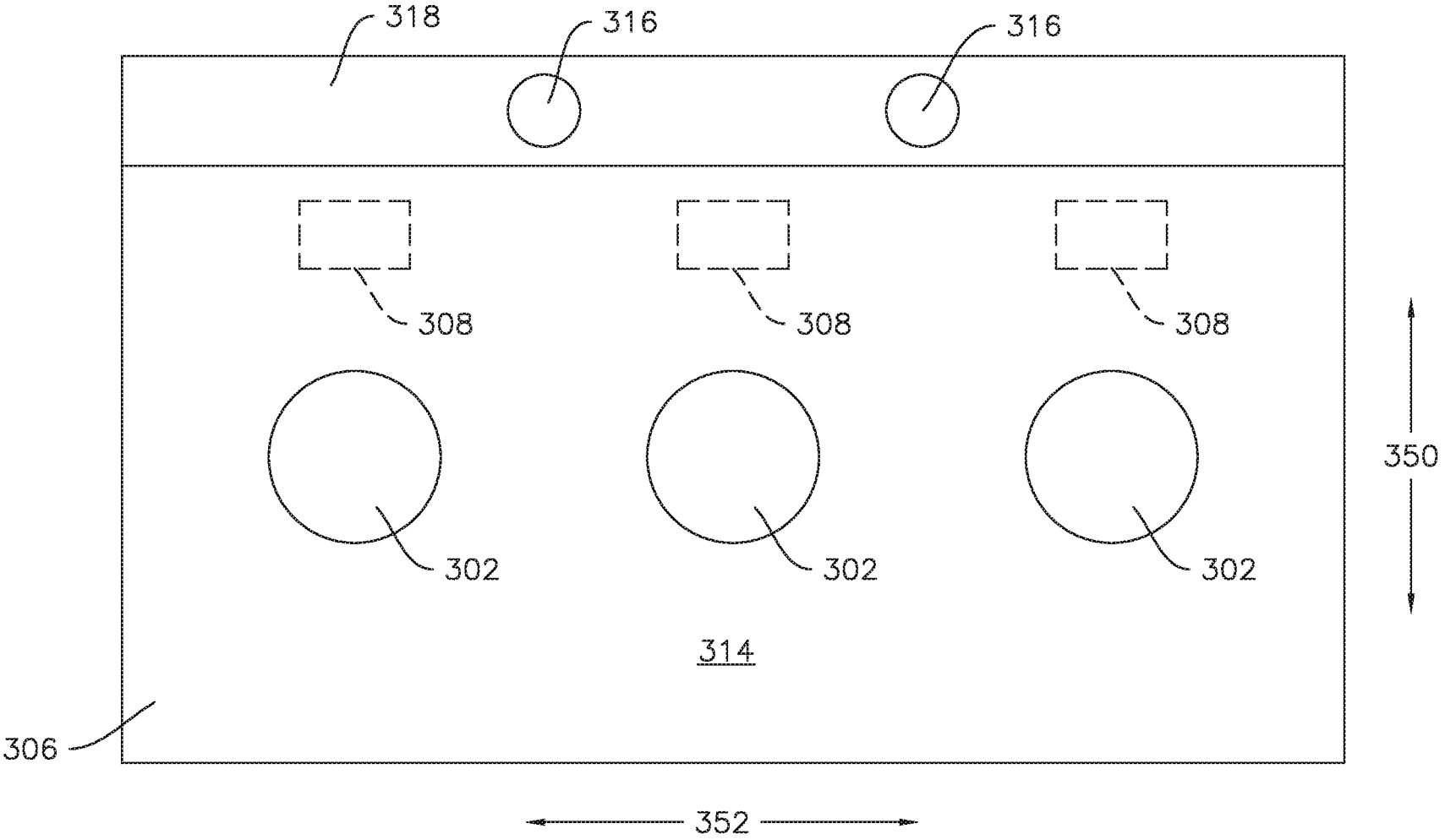
FIG. 4 provides a front view of a circuit board as may be incorporated into a control console for an appliance according to at least one additional exemplary embodiment of the present subject matter.
Figure 5:
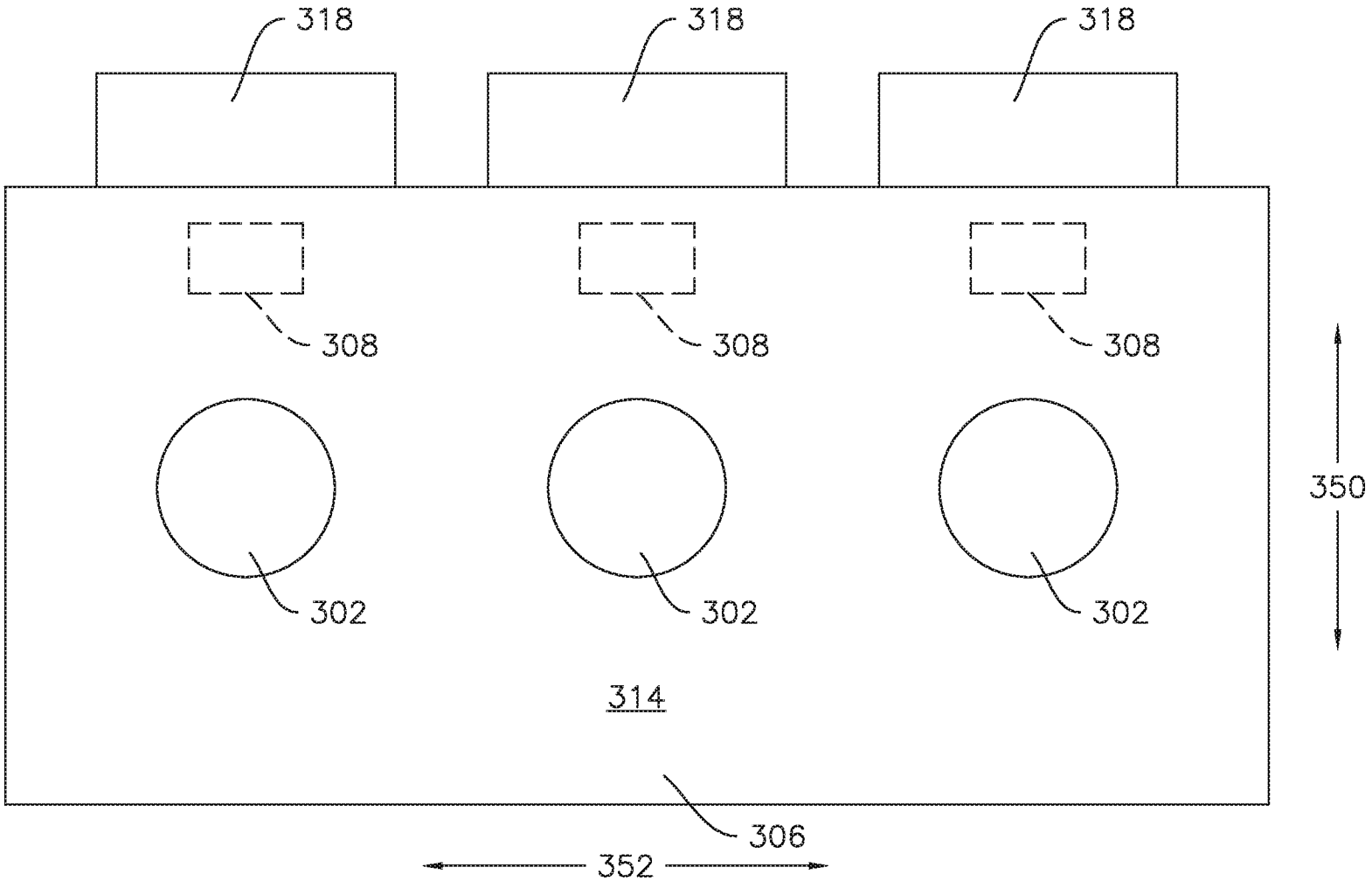
FIG. 5 provides a front view of a circuit board as may be incorporated into a control console for an appliance according to at least one further additional exemplary embodiment of the present subject matter.

In various embodiments of the present disclosure, the one or more LEDs 308 correspond to one or more buttons 302 of the control console 300. For example, the buttons 302 may each activate or select a respective cycle or option of the appliance 100, and the corresponding LED 308 may activate, e.g., illuminate, when the button 302 is pressed or touched to provide a visual indication and confirmation of the selected cycles/options of the appliance 100. In some embodiments, e.g., as in the example embodiment illustrated in FIG. 3, a single capacitive touch sensor 302 is the only input on the printed circuit board and a single LED 308 corresponding to the single capacitive touch sensor 302 is the only light on the printed circuit board 306. In other embodiments, a plurality of buttons (e.g., capacitive touch sensors) 302 may be provided on the same printed circuit board 306, such as three capacitive touch sensors 302 with three corresponding LEDs 308, as illustrated in FIGS. 4 and 5. In some embodiments with a plurality of LEDs 308 on the same printed circuit board 306, a single light guide 318 may be mounted on the printed circuit board 318 and the single light guide 318 may be in optical communication with each of the LEDs 308, e.g., as illustrated in FIG. 4. In such embodiments, the light guide may include light-blocking features 316, such as cores of opaque material, between adjacent LEDs 308 to prevent or minimize light bleed from one LED 308 to an adjacent LED 308 and/or the indicator 304 corresponding to the adjacent LED 308. In other embodiments with a plurality of LEDs 308 on the same printed circuit board 306, a separate light guide 318 may be provided in optical communication with each LED 308, e.g., as illustrated in FIG. 5.

As may be seen in FIGS. 3 through 9, the control console 300 generally defines a first direction 350, a second direction 352, and a third direction 354, where the first direction 350, second direction 352, and third direction 354 are mutually perpendicular. The directions or axes 350, 352, and 354 defined by the control console 300 may be generally aligned with the vertical, lateral, and transverse directions V, L, and T defined by the appliance 100. For example, as illustrated in FIGS. 1 and 2, the control console 300 may be positioned on a front of the appliance 100 and may face forward, such that the first direction 350 is generally aligned with the vertical direction V, the second direction 352 is generally aligned with the lateral direction L, and the third direction 354 is generally aligned with the transverse direction T. In other embodiments, the control console 300 may face upwards, e.g., such that the first direction 350 is generally aligned with one of the lateral direction L or the transverse direction T, the second direction 352 is generally aligned with the other of the lateral direction L or the transverse direction T, and the third direction 354 is generally aligned with the vertical direction V. Other alignments and orientations of the control console 300 are also possible, for example, the control console 300 may be oblique to some or all of the vertical, lateral, and transverse directions V, L, and T, e.g., the control console 300 may form an angle of at least about fifteen degrees (15°) with at least one of the vertical, lateral, and transverse directions V, L, and T. For example, the control console 300 may be generally aligned with the lateral direction L while forming an angle of between about fifteen degrees (15°) and about sixty degrees (60°), such as about forty-five degrees (45°), with each of the vertical and transverse directions V and T. Such examples may apply, e.g., when the control console 300 is disposed on a backsplash of an oven appliance or a laundry appliance.

The console cover 136 may be opaque and may, as mentioned above, have a variety of text, digits, and/or symbols printed thereon. Further, the console cover 136 may include a one or more apertures 330 extending through the console cover 136 from the interior surface 322 to the face surface 320 which may be associated with a corresponding LED 308. It should be understood that the apertures 330 in the console cover 136 may be "associated with" the LEDs 308 in that the apertures 330 are associated with each respective LED 308 in order to provide an indication to a user that an option or setting, etc. corresponding to the button 302 associated with the LED 308 is active or selected. In some embodiments, the indicators 304 may be defined by the apertures 330, e.g., each indicator 304 may be defined at an intersection of an aperture 330 with the face surface 320.

As may be seen in FIGS. 6 through 9, the printed circuit board 306 may be defined by and extend between a front surface 314 and a back surface 312 along the third direction 354. The LEDs 308 may be mounted on or to the back surface 312 of the printed circuit board 306, as mentioned above. In order to provide light from the LEDs 308 on the back surface 312 of the printed circuit board 306 to the indicators 304 on the face surface 320 of the console cover 136, a light guide 318 may extend along the third direction 354 between the LED 308 and the aperture 330.

Additionally, in some embodiments, the control console 300 may include one or more capacitive touch features, for example, one or more of the inputs or buttons 302 may be or include capacitive touch sensors. In embodiments which include such capacitive touch features, the console cover 136 may also be a dielectric panel. For example, the printed circuit board 306 may include one or more capacitive touch sensors embedded thereon, and the console cover 136 may comprise a dielectric material such that the console cover 136 provides a dielectric panel for the capacitive touch sensor(s). For example, as is generally understood by those of skill in the art, the printed circuit board 306 may include signal and power circuits on the printed circuit board 306 which are routed for the control console 300. Accordingly, the console cover 136 may be responsive to a touch from a user, e.g., on the exterior surface 320 thereof, by sensing or measuring a change in capacitance at the printed circuit board 306 due to the presence of, e.g., the user's finger on the exterior surface. In various embodiments, the capacitive touch sensor may operate on self capacitance, mutual capacitance, or combinations thereof and/or any other suitable configuration. The structure and function of such capacitive touch sensors are generally understood by those of skill in the art and, as such, are not shown or described in greater detail herein.

As may be seen for example in FIGS. 6 through 9, where the LED 308 is mounted on the back surface 312 of the printed circuit board 306 and is a side-fire LED 308, the LED 308 thereby provides illumination, e.g., emits light, parallel to the back surface 312 of the printed circuit board 306 along the first direction 350. In order to provide light from the LED 308 to the indicator 304 corresponding to the button 302 and LED 308, a light guide 318 may be mounted on the printed circuit board 306, as mentioned. The light guide 318 may be a translucent plastic material or any other suitable light-transmitting material.

Figure 6:
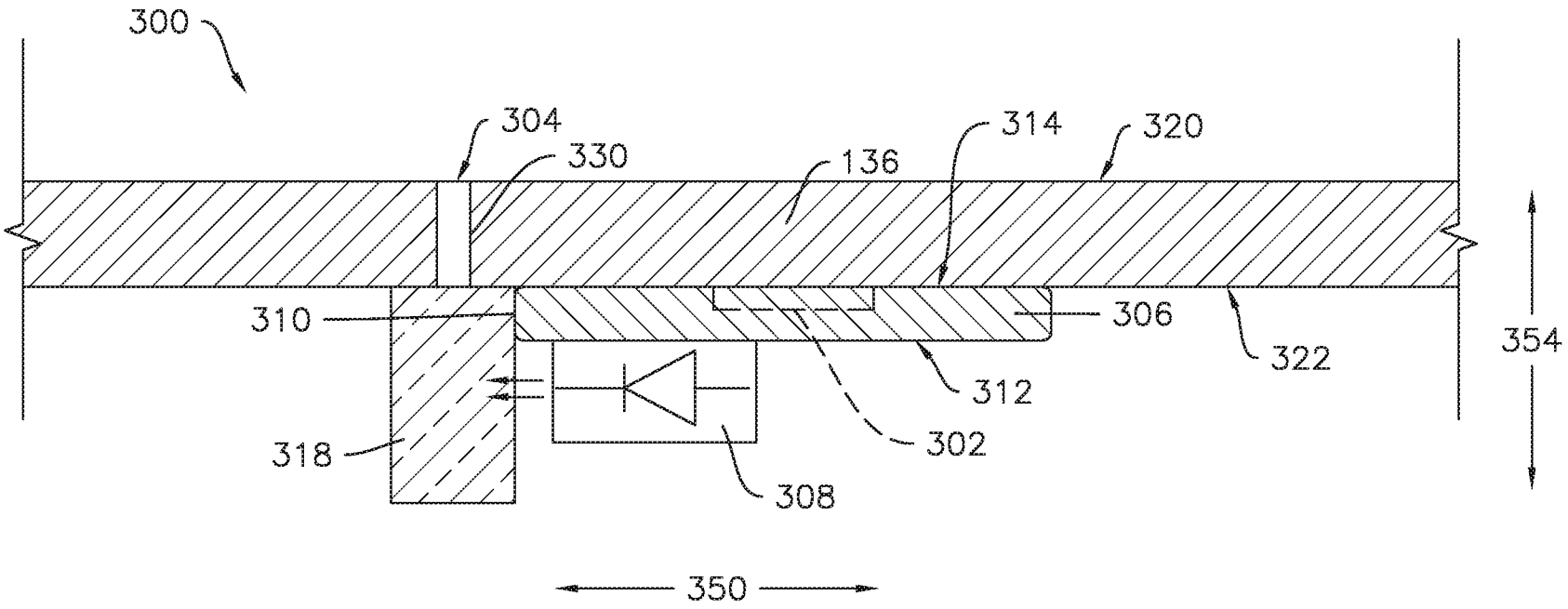
FIG. 6 provides a side, section view of a control console for an appliance according to at least one exemplary embodiment of the present subject matter.

In some embodiments, e.g., as illustrated in FIG. 6, the light guide 318 may be mounted on the edge surface 310 of the printed circuit board 306 and a top surface of the light guide 318 may be flush with the front surface 314 of the printed circuit board 306 and aligned with the aperture 330 in the console cover 136. As mentioned above, the aperture 330 in the console cover 136 may define the indicator 304 on the face surface 320 of the console cover 136. Thus, by transmitting light from the LED 308 to and through the aperture 330, the indicator 304 may be illuminated by the LED 308. The face surface 320 may also be considered an outer surface or a user-facing surface. Such construction may advantageously provide a light guide 318 with a simple form which promotes ease of manufacture and reduces costs.

Figure 7:
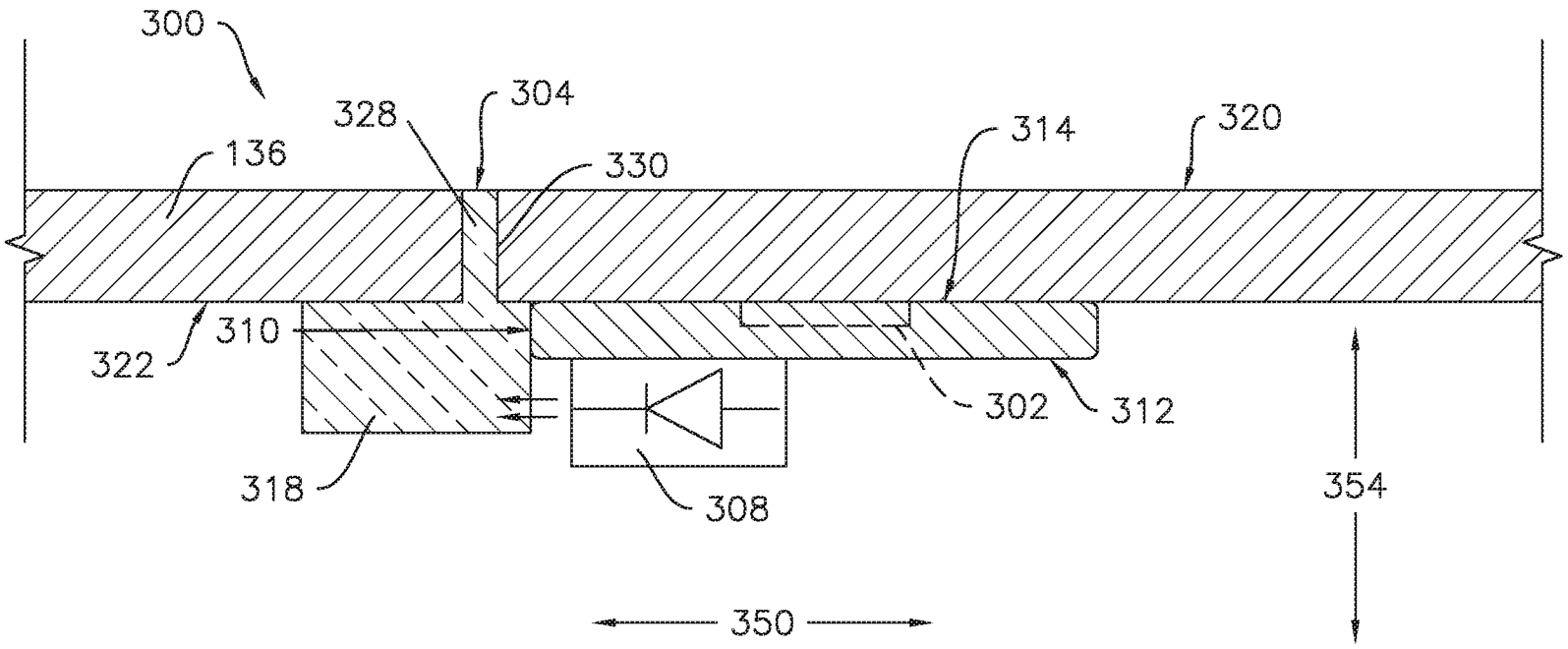
FIG. 7 provides a side, section view of a control console for an appliance according to at least one additional exemplary embodiment of the present subject matter.

In some embodiments, e.g., as illustrated in FIG. 7, the light guide 318 may be mounted on the edge surface 310 of the circuit board 306 and/or to the interior surface 322 of the console cover 136. In such embodiments, the light guide 318 may also include a protrusion 328. As illustrated, the protrusion 328 may extend along the third direction 354 at least partially through the aperture 330. For example, the protrusion 328 may extend through the aperture 330 to the indicator 304 at the face surface 320 of the console cover 136.

Figure 8:
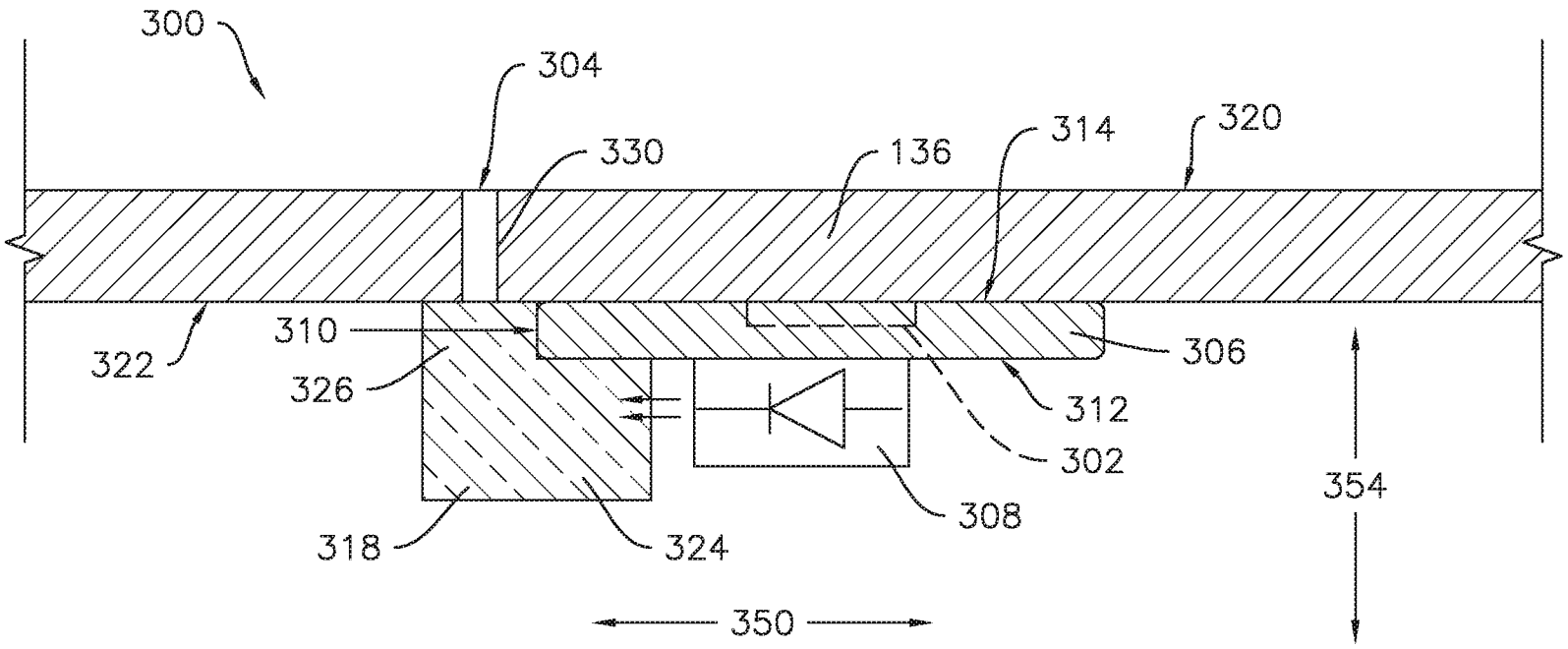
FIG. 8 provides a side, section view of a control console for an appliance according to at least one further additional exemplary embodiment of the present subject matter.

In other embodiments, e.g., as illustrated in FIG. 8, the light guide 318 may be L-shaped. For example, the light guide 318 may include a first leg 324 mounted on the back surface 312 of the printed circuit board 306 and a second leg 326 extending from the first leg 324 to the interior surface 322 of the console cover 136. Thus for example, the first leg 324 may extend along the first direction 350 and the second leg 326 may extend along the third direction 354. Such embodiments may provide a greater intensity, e.g., brightness, of light to the indicator 304.

Figure 9:
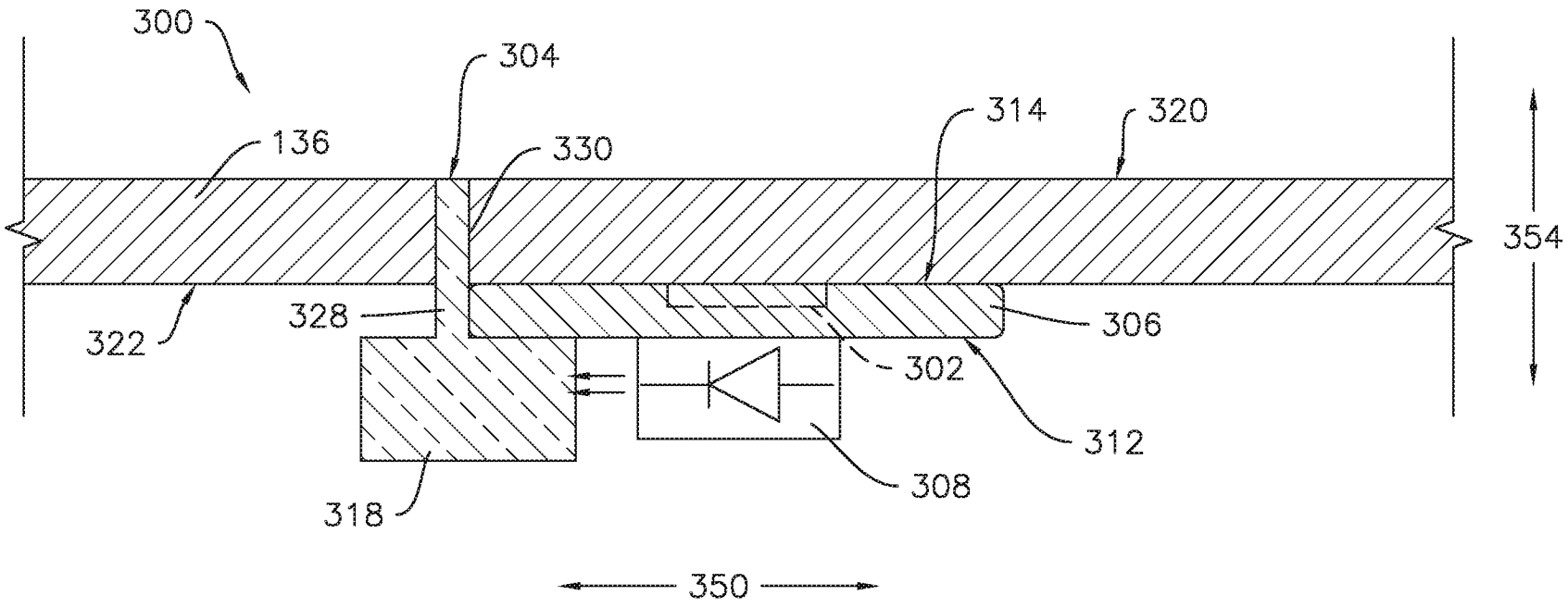
FIG. 9 provides a side, section view of a control console for an appliance according to at least one further additional exemplary embodiment of the present subject matter.

In some embodiments, for example as illustrated in FIG. 9, the light guide 318 may be mounted on the back surface 312 of the printed circuit board 306. In some such embodiments, the light guide 318 may also include the protrusion 328. As illustrated, the protrusion 328 may extend along the third direction 354 at least partially through the aperture 330, as described above with respect to FIG. 7.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet;

a door rotatably mounted to the cabinet for movement between a closed position and an open position; and a control console positioned on the door, the control console comprising:

a console cover extending from a face surface on an exterior surface of the door to an interior surface;

a circuit board comprising a front surface attached to the interior surface of the console cover;

a capacitive touch sensor in operative communication with the face surface of the console cover;

an LED mounted on a back surface of the circuit board opposite the front surface of the circuit board; and a light guide mounted on the circuit board, the light guide providing optical communication from the LED to the face surface of the console cover.

2. The appliance of claim 1, wherein the light guide is mounted on an edge surface of the circuit board.

3. The appliance of claim 1, wherein the light guide is mounted on the back surface of the circuit board.

4. The appliance of claim 1, wherein the light guide extends parallel to the console cover and is spaced apart from the console cover.

5. The appliance of claim 1, wherein the light guide comprises a first leg mounted on the back surface of the circuit board and a second leg extending from the first leg to the interior surface of the console cover.

6. The appliance of claim 1, wherein the console cover comprises an aperture extending through the console cover from the interior surface to the face surface, wherein the light guide is aligned with the aperture and provides direct optical communication from the LED to the face surface of the console cover through the aperture.

7. The appliance of claim 6, wherein the light guide comprises a protrusion, the protrusion extending into the aperture and through the aperture to the face surface of the console cover.

8. The appliance of claim 1, wherein the capacitive touch sensor is a single capacitive touch sensor and the LED is a single LED corresponding to the single capacitive touch sensor.

9. The appliance of claim 1, wherein the capacitive touch sensor is one of a plurality of capacitive touch sensors in operative communication with the face surface of the console cover and the LED is one of a plurality of LEDs on the back surface of the circuit board, each LED of the plurality of LEDs corresponding to one capacitive touch sensor of the plurality of capacitive touch sensors, and wherein the light guide is a single light guide, the single light guide providing direct optical communication from each LED of the plurality of LEDs to the face surface of the console cover.

10. The appliance of claim 1, wherein the appliance is a dishwasher appliance comprising a wash chamber defined in the cabinet, wherein the door sealingly encloses the wash chamber when the door is in the closed position and the door permits access to the wash chamber when the door is in the open position.

11. A control console for an appliance, comprising:

a console cover extending from a face surface to an interior surface;

a circuit board comprising a front surface attached to the interior surface of the console cover;

a capacitive touch sensor in operative communication with the face surface of the console cover;

an LED mounted on a back surface of the circuit board opposite the front surface of the circuit board; and a light guide mounted on the circuit board, the light guide providing optical communication from the LED to the face surface of the console cover.

12. The control console of claim 11, wherein the light guide is mounted on an edge surface of the circuit board.

13. The control console of claim 11, wherein the light guide is mounted on the back surface of the circuit board.

14. The control console of claim 11, wherein the light guide extends parallel to the console cover and is spaced apart from the console cover.

15. The control console of claim 11, wherein the light guide comprises a first leg mounted on the back surface of the circuit board and a second leg extending from the first leg to the interior surface of the console cover.

16. The control console of claim 11, wherein the console cover comprises an aperture extending through the console cover from the interior surface to the face surface, wherein the light guide is aligned with the aperture and provides direct optical communication from the LED to the face surface of the console cover through the aperture.

17. The control console of claim 16, wherein the light guide comprises a protrusion, the protrusion extending into the aperture and through the aperture to the face surface of the console cover.

18. The control console of claim 11, wherein the capacitive touch sensor is a single capacitive touch sensor and the LED is a single LED corresponding to the single capacitive touch sensor.

19. The control console of claim 11, wherein the capacitive touch sensor is one of a plurality of capacitive touch sensors in operative communication with the face surface of the console cover and the LED is one of a plurality of LEDs on the back surface of the circuit board, each LED of the plurality of LEDs corresponding to one capacitive touch sensor of the plurality of capacitive touch sensors, and wherein the light guide is a single light guide, the single light guide providing direct optical communication from each LED of the plurality of LEDs to the face surface of the console cover.

20. The control console of claim 11, wherein the control console is positioned in a door of a dishwasher appliance.

* * * * *